United States Patent [19]

Ooka

[11] 4,224,802

[45] Sep. 30, 1980

[54] APPARATUS AND PROCESS FOR VAPORIZING LIQUEFIED NATURAL GAS

[75] Inventor: Isami Ooka, Osaka, Japan

[73] Assignee: Osaka Gas Company, Limited, Japan

[21] Appl. No.: 24,535

[22] Filed: Mar. 28, 1979

[30] Foreign Application Priority Data

Mar. 28, 1978 [JP] Japan ..... 53/36401
Mar. 28, 1978 [JP] Japan ..... 53/36402

[51] Int. Cl.[3] ..... F17C 7/02
[52] U.S. Cl. ..... 62/52; 62/434
[58] Field of Search ..... 62/52, 53, 434

[56] References Cited

U.S. PATENT DOCUMENTS

| | | | |
|---|---|---|---|
| 3,319,435 | 5/1967 | Boyd et al. | 62/52 |
| 3,535,210 | 10/1970 | Linde et al. | 62/52 |
| 3,675,436 | 7/1962 | Ganiaris | 62/52 |
| 3,712,073 | 1/1973 | Arenson | 62/52 |
| 3,986,340 | 10/1976 | Bivins, Jr. | 62/53 |

*Primary Examiner*—Ronald C. Capossela
*Attorney, Agent, or Firm*—Larson, Taylor and Hinds

[57] ABSTRACT

The apparatus for vaporizing LNG comprises a heat exchanger of the intermediate fluid type and a multitubular heat exchanger, both heat exchangers using estuarine water or warm effluent water as a heat source. The process for vaporizing LNG comprises the heat exchange steps between LNG and a heating medium and between the heating medium and estuarine water or warm effluent water in an intermediate fluid type heat exchanger, and the heat exchange step between the vaporized natural gas and estuarine water or warm effluent water in a multitubular heat exchanger.

24 Claims, 2 Drawing Figures

APPARATUS AND PROCESS FOR VAPORIZING LIQUEFIED NATURAL GAS

This invention relates to an apparatus and process for vaporizing liquefied natural gas, and more particularly to an apparatus and process for vaporizing liquefied natural gas to natural gas heated to a temperature suitable for use, for example to a temperature of about 0° to about 30° C.

As is well known, liquefied natural gas has a low temperature of about −160° C. Accordingly, hot water or steam, when used to heat the liquefied gas for vaporization, freezes, giving rise to the hazard of clogging up the evaporator. Various improvements have therefore been made. The evaporators presently used are mainly of the open rack type, intermediate fluid type and submerged combustion type.

Open rack type evaporators use seawater as a heat source for countercurrent heat exchange with liquefied natural gas. Evaporators of this type are free of clogging due to freezing, easy to operate and to maintain and are accordingly widely used. However, they inevitably involve icing up on the surface of the lower portion of the heat transfer tube, consequently producing increased resistance to heat transfer, so that the evaporator must be designed to have an increased heat transfer area, namely a greater capacity, which entails a higher equipment cost. To ensure improved heat efficiency, evaporators of this type include an aluminum alloy heat transfer tube of special configuration. This renders the evaporators economically further disadvantageous.

Instead of vaporizing liquefied natural gas by direct heating with hot water or steam, evaporators of the intermediate fluid type use propane, fluorinated hydrocarbons or like refrigerant having a low freezing point, such that the refrigerant is heated with hot water or steam first to utilize the evaporation and condensation of the refrigerant for the vaporization of liquefied natural gas. Evaporators of this type are less expensive to build than those of the open rack type but require heating means such as a burner for the preparation of hot water or steam and are therefore costly to operate owing to the fuel consumption.

Evaporators of the submerged combustion type comprise a tube immersed in water which is heated with a combustion gas injected thereinto from a burner to heat with the water the liquefied natural gas passing through the tube. Like the intermediate fluid type, evaporators of the third type involve a fuel cost and is expensive to operate.

The main object of this invention is to provide an apparatus and process for vaporizing liquefied natural gas which utilize water from the sea, river or lake, namely estuarine water, or warm water effluent from various industrial processes as the heat source without the necessity of using any fuel and which are economical to operate and inexpensive to construct.

Another object of this invention is to provide an efficient apparatus and process for vaporizing liquefied natural gas which utilize estuarine water or warm effluent water as the heat source and which are entirely free of clogging due to freezing of the heat source water, the evaporator being capable of producing vaporized natural gas heated to a temperature close to the temperature of the heat source water, for example, to a temperature of about 0° to about 30° C.

Another object of this invention is to provide an apparatus and process for vaporizing liquefied natural gas with savings in the quantity of the heat source water used and with reduced head loss.

Another object of this invention is to provide an apparatus and process for vaporizing liquefied natural gas with safety using the above-mentioned heat source water having a temperature in a wide range, for example, of about 0° to about 30° C.

These and other objects of this invention will become apparent from the following description.

This invention provides process and apparatus for vaporizing liquefied natural gas comprising a heat exchanger of the intermediate fluid type for forming vaporized natural gas from the liquefied natural gas with use of estuarine water or warm effluent water as a heat source and a refrigerant as a heat medium, and a multitubular heat exchanger for heating the vaporized natural gas from the heat exchanger by subjecting the vaporized natural gas to heat exchange with estuarine water or warm effluent water serving as a heat source.

According to this invention, the heat exchanger of the indirectly heating, intermediate fluid type contains a refrigerant as enclosed therein. The refrigerant enclosed in the exchanger is divided into a lower liquid portion and an upper vapor portion.

Examples of useful refrigerants are those already known, among which inexpensive refrigerants having the lowest possible freezing point are preferable to use. More specific examples are propane (freezing point: −189.9° C., boiling point: −42.1° C.), fluorinated hydrocarbons such as "Freon-12" ($CCl_2F_2$, freezing point: −157.8° C., boiling point: −29.8° C.), etc. and ammonia (freezing point: −77.7° C., boiling point: −33.3° C.).

The refrigerant within the exchanger is used usually at increased pressure which, although variable with the operating conditions, is generally in the range of about 0 to about 5 kg/cm$^2$. The pressures in this specification are expressed all in the terms of gauge pressure.

The lower portion of the heat exchanger where the liquid refrigerant portion is present is provided with passages for estuarine water or warm effluent water serving as the heat source. The lower liquid refrigerant portion is indirectly heated with the water flowing through the passages and the vaporized refrigerant flows into the upper vapor portion. On the other hand, the upper vapor refrigerant portion is used for heating liquefied natural gas through heat exchange, whereupon the vapor condenses. The condensed refrigerant returns to the lower liquid portion. In this way, the refrigerant undergoes vaporization and condensation repeatedly.

Since the lower liquid refrigerant portion in the heat exchanger has a very low temperature, there is the likelihood that when effecting heat exchange between the estuarine water of warm effluent water and the refrigerant, the water will freeze within the passages, but this problem can be readily overcome by increasing the velocity of the flow of the water through the passages. However, the flow velocity is limited from the viewpoint of economy, so that it should be avoided to reduce the temperature of the refrigerant to an exceedingly low level. Usually, the temperature of the refrigerant is not lower than about −10° C. (at about 2.5 kg/cm$^2$) for propane and not lower than about −15° C. (at about 0.9 kg/cm$^2$) for Freon-12 when the water has a temperature of about 6° C. before entering the heat exchanger and a flow velocity of about 2 m/sec. The heating of the refrigerant with the water to a temperature not higher than the freezing point of the water makes it possible to use a smaller heat transfer area than the heating of the refrigerant with the water to a temperature not lower than the freezing point of the water.

The upper portion of the heat exchanger accommodating the vapor refrigerant is provided with passages for the liquefied natural gas. The liquefied natural gas flowing through the passages is heated with the vapor refrigerant and vaporized during its passage therethrough. The liquefied natural gas is admitted to the passages usually at elevated pressure which is generally about 5 to about 100 kg/cm$^2$ although widely variable.

Since the heat exchanger is followed by another heat exchanger serving as an after heater, the objects of this invention can be fully achieved insofar as the liquefied natural gas is almost vaporized by the intermediate fluid type exchanger although the vaporized gas obtained has a low temperature. For example, when the liquefied natural gas is fed to the exchanger at pressure of about 10 to about 70 kg/cm$^2$, the vaporized natural gas egressing from the exchanger has a temperature of about −30° to about −50° C. Accordingly, the operation can be carried out with a smaller heat transfer area between liquefied natural gas and refrigerant than when one heat exchanger vaporizes liquefied natural gas and heats the vaporized gas to a temperature of about 0° to about 30° C. at the same time.

According to this invention, the area of heat transfer between the heat source water and the refrigerant as well as the area of heat transfer between the refrigerant and the liquefied natural gas can be reduced, with the result that the intermediate fluid type exchanger can be made compact.

According to this invention, a multitubular heat exchanger is arranged in series with the heat exchanger described above. The vaporized natural gas having a low temperature (about −30° to about −50° C.) and run off from the heat exchanger of the intermediate fluid type is introduced into the multitubular heat exchanger, in which the gas is brought into contact with heat source water and is thereby heated to a temperature close to the temperature of the water.

The estuarine water or warm effluent water useful as the heat source in this invention has an ambient temperature for example of about 0° to about 30° C. The water is admitted to the heat exchangers at a sufficiently high velocity for example of about 1.5 m/sec to about 3.0 m/sec in order to avoid freezing.

The intermediate fluid type heat exchanger and the multitubular heat exchanger may be arranged either in series or in parallel with respect to the supply of the heat source water. In the former case, the water must be passed from the multitubular heat exchanger to the intermediate fluid type heat exchanger. The series mode of supply leads to savings in the quantity of heat source water used.

When the heat source water is supplied to both the heat exchangers in a parallel manner, the multitubular heat exchanger is provided with a water supply circuit for countercurrent or concurrent contact with the vaporized natural gas. Alternatively the countercurrent circuit and concurrent circuit may be provided in combination, in which case one of the circuits may be operated selectively by changing over the valves provided for the circuits in accordance with the temperature of the heat source water. For instance, the countercurrent circuit is operated when the water has a relatively high temperature, whereas the concurrent circuit is used when the water has an extremely low temperature.

The heat exchange between the vaporized natural gas and the heat source water in the multitubular heat exchanger can be effected more advantageously by countercurrent contact than by concurrent contact from the viewpoint of thermal efficiency.

The vaporized natural gas, when entering the heat exchanger, has a low temperature for example of about −30° to about −50° C. Accordingly there is the likelihood that the heat source water will ice the inner surface of the heat transfer tube on heat exchange with the vaporized natural gas. This is more likely to take place with countercurrent contact than with concurrent contact.

When the heat source water has a high temperature and involves only a reduced likelihood of freezing, therefore, the valves are operated to function the countercurrent circuit to permit efficient heat exchange between the water and the vaporized natural gas, whereas when the heat source water has a low temperature and is more susceptible to freezing, the concurrent circuit is operated to avoid the hazard of freezing while somewhat sacrificing the thermal efficiency.

When the heat exchanger is operated concurrently or countercurrently in accordance with the temperature condition of the heat source water in the manner described above, the heat source water and the vaporized natural gas can be subjected to heat exchange without entailing the trouble of icing that would clog the heat transfer tube.

As already described, the heat transfer between the estuarine water or warm effluent water and the refrigerant and the heat transfer between the refrigerant and the liquefied natural gas can be carried out over a reduced area within the intermediate fluid type heat exchanger of this invention, so that the heat exchanger can be built very compact. Additionally, a multitubular heat exchanger which is inexpensively available is usable as arranged in series with this heat exchanger. Consequently, the overall evaporator can be constructed at a greatly reduced cost. The evaporator is further inexpensive to operate because estuarine water or warm effluent water is used as the heat source.

The features of this invention will be described below with reference to embodiments of the invention and to the drawings, in which:

FIG. 1 shows an embodiment of this invention in which heat source water is supplied to a multitubular heat exchanger 2 of the countercurrent type, from which the water is fed to a heat exchanger 1 of the intermediate fluid type in a series manner.

Figure 1:
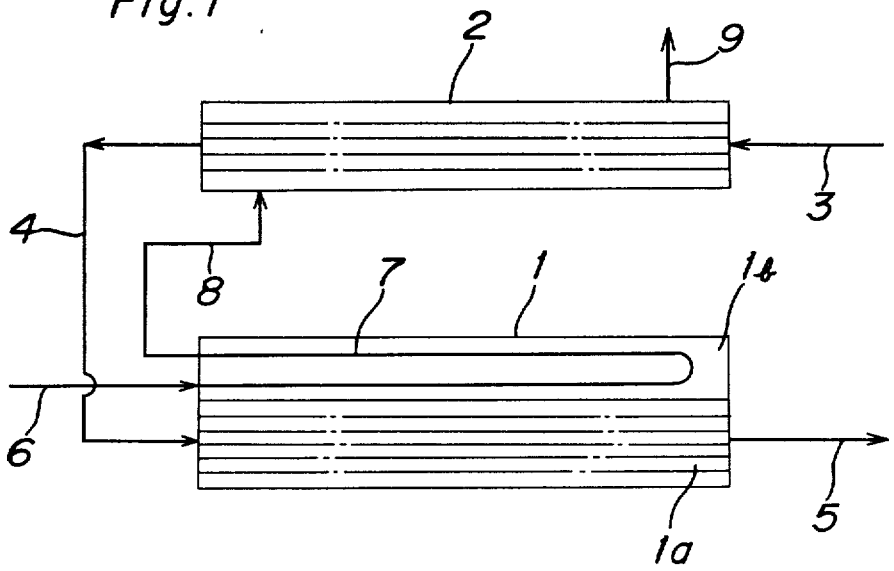
FIG. 1 is a front view schematically showing an apparatus of this invention in which heat source water is supplied in a series fashion.

With this embodiment, heat source water such as seawater or warm effluent water is admitted through a line 3 into the heat exchanger 2, in which the water is used first for heating the vaporized natural gas mentioned below. The heat source water is then passed through a line 4 into the heat exchanger 1. While flowing through the lower portion 1*a* of the exchanger 1, the water is subjected to heat exchange with a refrigerant, such as propane or Freon-12, contained in the lower portion 1*a* in the form of a liquid, giving heat to the refrigerant, and is run off via a line 5. Part of the refrigerant heated with the heat source water evaporates to form a vapor phase at the upper portion 1b of the exchanger 1 to undergo heat exchange with the liquefied natural gas to be stated below.

Liquefied natural gas is introduced via a line 6 into the upper portion 1b of the intermediate fluid type heat exchanger 1, in which the gas is subjected to heat exchange with the vapor-phase refrigerant accommodated in the upper portion 1b while flowing through a line 7 and vaporizes on receipt of heat from the refrigerant. The vaporized natural gas flows through a line 8 into the multitubular heat exchanger 2, in which the gas undergoes heat exchange with the heat source water and therewith heated. The gas is thereafter collected by way of a line 9. Part of the vapor-phase refrigerant subjected to heat exchange with the liquefied natural gas returns on condensation to the liquid phase in the lower portion 1a, where it is heated with the heat source water again and vaporizes. The vaporized refrigerant returns to the upper portion 1b. In this way, the refrigerant undergoes condensation and evaporation in repetition, thus circulating through the exchanger 1 between the upper portion 1b and lower portion 1a thereof.

The apparatus of this invention described above, in which the heat source water is passed through the exchangers in a series mode, requires a lesser amount of the heat source water than otherwise and is therefore especially useful when the water supply is limited as is the case with warm effluent water.

Figure 2:
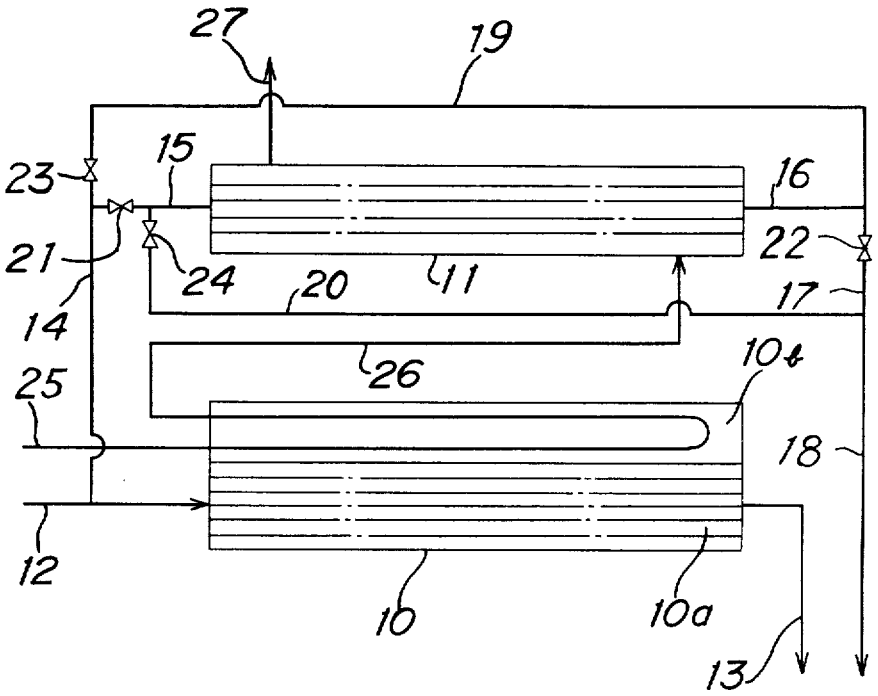
FIG. 2 is a front view schematically showing another apparatus of this invention in which heat source water is supplied in a parallel manner.

FIG. 2 shows another embodiment of this invention comprising an intermediate fluid type heat exchanger 10 and a multitubular heat exchanger 11 which are arranged in parallel with respect to the supply of heat source water. The multitubular heat exchanger 11 includes a countercurrent circuit and a concurrent circuit.

With this embodiment, heat source water is supplied via a line 12 to the intermediate fluid type heat exchanger 10, in which the water heats a liquid-phase refrigerant in a lower portion 10a, causing part of the refrigerant to evaporate. The water is thereafter drawn off through a line 13.

The heat source water is fed to the multitubular heat exchanger 11 through a countercurrent circuit comprising lines 12, 14, 15, 16, 17 and 18, or through a concurrent circuit comprising lines 12, 14, 19, 16, 15, 20 and 18. Change-over between the countercurrent circuit and the concurrent circuit is effected by operating valves 21, 22, 23 and 24 on the lines mentioned above. The valves 21 and 22 are opened and the valves 23 and 24 are closed when the countercurrent circuit is to be operated. To function the concurrent circuit, the valves 23 and 24 are opened with the valves 21 and 22 closed.

Liquefied natural gas is fed to the intermediate fluid type heat exchanger 10 via a line 25. While flowing through the vapor-phase refrigerant in the upper portion 10b of the heat exchanger 10, the liquid gas is subjected to heat exchange with the refrigerant and vaporizes on receipt of heat. The vaporized gas is introduced into the multitubular heat exchanger 11 through a line 26. On the other hand, part of the refrigerant vapor releases heat on heat exchange and condenses to return to the liquid phase in the lower portion 10a. The vaporized natural gas sent through the line 26 into the heat exchanger 11 is subjected to heat exchange with the heat source water in countercurrent or concurrent relation thereto and is thereby heated. The gas is collected by way of a line 27.

When the heat source water has a relatively high temperature for example of about 5° to about 30° C., the water is fed to the multitubular heat exchanger 11 through the countercurrent circuit, subjecting the vaporized natural gas to heat exchange with the water in countercurrent relation thereto with high thermal efficiency.

When the heat source water has a relatively low temperature for example of about 0° to about 5° C., the water is supplied to the multitubular heat exchanger 11 through the concurrent circuit, causing the vaporized natural gas to undergo heat exchange with the water in concurrent relation thereto, whereby the gas is heated. The heat exchange thus effected concurrently, although thermally not very efficient, will result in a correspondingly lesser reduction in the temperature of the heat source water, thus eliminating the likelihood that the heat transfer tubes will be clogged up by icing. The apparatus can therefore be operated with safety even with use of heat source water of relatively low temperature.

EXAMPLES 1 AND 2

Liquefied natural gas (LNG) is vaporized by an apparatus for this invention as schematically shown in FIG. 1. The results are listed in Table 1 below.

Table 1

| Example | 1 | 2 |
|---|---|---|
| LNG flow rate (tons/hr.) | 100 | 150 |
| LNG pressure ($kg/cm^2$ G) | 33 | 33 |
| Temp. of LNG at inlet of exchanger 1 (°C.) | −150 | −150 |
| Temp. of LNG at outlet of exchanger 1 (°C.) | −28 | −32 |
| Temp. of LNG at outlet of exchanger 2 (°C.) | 4 | 6 |
| Seawater flow rate (tons/hr.) | 3,000 | 3,000 |
| Temp. of seawater at inlet of exchanger 2 (°C.) | 6 | 10 |
| Temp. of seawater at outlet of exchanger 1 (°C.) | 0 | 1 |
| Seawater head loss* (m) | 8.0 | 7.0 |
| Intermediate heat medium | propane | propane |
| Temp. of medium (°C.) | −15 | −14 |

*Seawater head loss is calculated from the average thickness of ice coating on the heat transfer surface.

Experiments show that a conventional open rack type evaporator requires 5000 tons/hr. of seawater having the same temperature as in Table 1 when vaporizing liquefied natural gas in the same amount as in Table 1 to obtain vaporized liquefied natural gas of the same temperature as in Table 1.

According to this invention, amount of seawater to be used can be reduced by about 40% as compared with conventional open rack type evaporator.

EXAMPLES 3 TO 6

Liquefied natural gas (LNG) is vaporized by an apparatus of this invention as schematically shown in FIG. 2. The results are listed in Table 2 below.

Table 2

| | Countercurrent | | Concurrent | |
|---|---|---|---|---|
| Example | 3 | 4 | 5 | 6 |
| LNG flow rate | | | | |

Table 2-continued

| Example | Countercurrent 3 | Countercurrent 4 | Concurrent 5 | Concurrent 6 |
|---|---|---|---|---|
| (tons/hr.) | 80 | 80 | 80 | 80 |
| LNG pressure ($kg/cm^2$ G) | 33 | 33 | 33 | 33 |
| Temp. of LNG at inlet of exchanger 10 (°C.) | −150 | −150 | −150 | −150 |
| Temp. of LNG at outlet of exchanger 10 (°C.) | −39 | −37 | −45 | −39 |
| Temp. of LNG at outlet of exchanger 11 (°C.) | 3 | 4 | −1 | 1 |
| Seawater flow rate of exchanger 10 (tons/hr.) | 2,000 | 2,000 | 2,000 | 2,000 |
| Seawater flow rate of exchanger 11 (tons/hr.) | 800 | 800 | 800 | 800 |
| Seawater temp. at inlet of exchangers 10 and 11 (°C.) | 6 | 7 | 5 | 6 |
| Seawater temp. at outlet of exchanger 10 (°C.) | 0 | 1 | 0 | 0 |
| Seawater temp. at outlet of exchange 11 (°C.) | 3 | 4 | 1 | 3 |
| Seawater head loss of exchanger 10 (m) | 2.98 | 2.83 | 3.84 | 2.98 |
| Seawater head loss of exchanger 11 (m) | 3.57 | 3.10 | 3.56 | 3.17 |
| Intermediate heat medium | propane | propane | propane | propane |
| Temp. of medium (°C.) | −12 | −10 | −19 | −12 |

I claim:

1. Apparatus for vaporizing liquefied natural gas and heating the vaporized gas to a temperature suitable for use with estuarine water or warm effluent water as the heat source comprising:

(i) a heat exchanger of the indirect heating type having enclosed therein an intermediate heating medium divided into a lower liquid portion and an upper vapor portion for producing varporized natural gas of about −30° to about −50° C. from the liqufied natural gas, an inlet for introducing estuarine water or warm effluent water into said lower liquid portion for indirect heat exchange with said intermediate heating medium, an outlet for discharging the water from said lower liquid portion after said indirect heat exchange with said intermediate heating medium, said intermediate heating medium being heated to a vaporization temperature which is not higher than the freezing point of said water by said indirect heat exchange therewith in said lower liquid portion, the vaporized intermediate heating medium passing to said upper vapor portion, an inlet for introducing liquid natural gas into said upper vapor portion for indirect heat exchange with the vaporized intermediate heat exchange medium to vaporize said liquid natural gas, and an outlet for discharge of vaporized natural gas, and (ii) a multitubular heat exchanger for heating the vaporized gas from the first heat exchanger to a temperature suitable for use by heat exchange between the gas and estuarine water or warm effluent water, the heat exchanger having an inlet and an outlet for the gas and an inlet and an outlet for the water, the gas inlet being in fluid communication with the gas outlet of the first heat exchanger and the water outlet being in fluid communication with the water inlet of the first heat exchanger.

2. Apparatus as defined in claim 1 wherein the intermediate heat exchange medium comprises propane, fluorinated hydrocarbons or ammonia.

3. Apparatus as defined in claim 2 wherein the intermediate heat exchange medium comprises propane which is maintained at a temperature not lower than about −10° C. (at about 2.5 $kg/cm^2$ gauge) within the heat exchanger of the intermediate fluid type.

4. Apparatus as defined in claim 2 wherein the intermediate heat exchange medium comprises a fluorinated hydrocarbon.

5. Apparatus as defined in claim 4 wherein the intermediate heat exchange medium comprises Freon-12 which is maintained at a temperature not lower than about −15° C. (at about 0.9 $kg/cm^2$ gauge) within the heat exchanger of the intermediate fluid type.

6. Apparatus as defined in claim 1 wherein the intermediate heat exchange medium is maintained at an increased pressure of about 0 to about 5 $kg/cm^2$ gauge within the heat exchanger of the intermediate fluid type.

7. A process for vaporizing liquefied natural gas and heating the vaporized gas to a temperature suiable for use with estuarine water or warm effluent water as the heat source comprising the steps of:

(i) heating a liquefied refrigerant in indirect heat exchange with estuarine water or warm effluent water from step (iii) to a temperature not higher than the freezing point of the water to produce vaporized refrigerant, the flow velocity of water being at a value preventing its freezing, (ii) heating liquefied natural gas in indirect heat exchange with the vaporized refrigerant to produce vaporized natural gas having a low temperature of about −30° to about −50° C. and to liquefy the refrigerant, the liquefied refrigerant being returned to step (i), (iii) heating the low-temperature vaporized natural gas from step (i) to a temperature suitable for use in heat exchange with estuarine water or warm effluent water as the heat source, and (iv) passing the heat source water used in step (iii) into step (i).

8. A process as defined in claim 7 wherein the refrigerant comprises propane, fluorinated hydrocarbons or ammonia.

9. A process as defined in claim 8 wherein the refrigerant comprises propane which is maintained at a temperature not lower than about −10° C. (at about 2.5 $kg/cm^2$ gauge) within the heat exchanger of the intermediate fluid type.

10. A process as defined in claim 8 wherein the refrigerant comprises a fluorinated hydrocarbon.

11. A process as defined in claim 10 wherein the refrigerant comprises Freon-12 which is maintained at a temperature now lower than about −15° C. (at about 0.9 $kg/cm^2$ gauge) within the heat exchanger of the intermediate fluid type.

12. A process as defined in claim 7 wherein the refrigerant is maintained at an increased pressure of about 0 to about 5 $kg/cm^2$ gauge within the heat exchanger of the intermediate fluid type.

13. Apparatus for vaporizing liqudfied natural gas and heating the vaporized gas to a temperature suitable for use with estuarine water or warm effluent water as the heat source comprising:

(i) a heat exchanger of the indirect heating type having enclosed therein an intermediate heating medium divided into a lower liquid portion and an upper vapor portion for producing vaporized natural gas of about −30° to about −50° C. from the liquefied natural gas, an inlet for introducing the water into said lower liquid portion for indirect heat exchange with said intermediate heating medium, an outlet for discharging the water from said lower liquid portion after said indirect heat exchange with said intermediate heating medium, said intermediate heating medium being heated to a vaporization temperature which is not higher than the freezing point of said water by said indirect heat exchange therewith in said lower liquid portion, the vaporized intermediate heating medium passing to said upper vapor portion, an inlet for introducing liquid natural gas into said upper vapor portion for indirect heat exchange with the vaporized intermediate heat exchange medium to vaporize said liquid natural gas, and an outlet for discharge of vaporized natural gas, (ii) a multitubular heat exchanger for heating the vaporized gas from the first heat exchanger to a temperature suitable for use by heat exchange between the gas and estuarine water or warm effluent water, the heat exchanger having an inlet and an outlet for the gas and an inlet and a discharge outlet for estuarine water, and the gas inlet being in fluid communication with the gas outlet of the first heat exchanger, and (iii) valves for changing over the direction of water flow in the multitubular heat exchanger for effecting concurrent contact or countercurrent contact between the water and the vaporized gas.

14. Apparatus as defined in claim 13 wherein the intermediate heat exchange medium comprises propane, fluorinated hydrocarbons or ammonia.

15. Apparatus as defined in claim 14 wherein the intermediate heat exchange medium comprises propane which is maintained at a temperature not lower than about −10° C. (at about 2.5 kg/cm$^2$ gauge) within the heat exchanger of the intermediate fluid type.

16. Apparatus as defined in claim 14 wherein the intermediate heat exchange medium comprises a fluorinated hydrocarbon.

17. Apparatus as defined in claim 16 wherein the intermediate heat exchange medium comprises Freon-12 which is maintained at a temperature not lower than about −15° C. (at about 0.9 kg/cm$^2$ gauge) within the heat exchanger of the intermediate fluid type.

18. Apparatus as defined in claim 13 wherein the intermediate heat exchange medium is maintained at an increased pressure of about 0 to about 5 kg/cm$^2$ gauge within the heat exchanger of the intermediate fluid type.

19. A process for vaporizing liquefied natural and heating the vaporized gas to a temperature suitable for use with estuarine water or warm effluent water as the heat source comprising the steps of:

(i) heating a liquefied refrigerant in indirect heat exchange with estuarine water or warm effluent water to a temperature not higher than the freezing point of the water to produce vaporized refrigerant, the flow velocity of the water being at a value preventing its freezing, (ii) heating liquefied natural gas in indirect heat exchange with the vaporized refrigerant to produce vaporized natural gas having a low temperature of about −30° to about −50° C. and to liquefy the refrigerant, the liquefied refrigerant being returned to step (i), (iii) heating the low-temperature vaporized natural gas from step (i) to a temperature suitable for use in concurrent or countercurrent indirect heat exchange with estuarine water or warm effluent water, the changing over of the direction of the water flow relative to the direction of the gas flow being effected by valves depending on the temperature of the water.

20. A process as defined in claim 19 wherein the refrigerant comprises propane, fluorinated hydrocarbons or ammonia.

21. A process as defined in claim 20 wherein the refrigerant comprises propane which is maintained at a temperature not lower than about −10° C. (at about 2.5 kg/cm$^2$ gauge) within the heat exchanger of the intermediate fluid type.

22. A process as defined in claim 20 wherein the refrigerant comprises a fluorinated hydrocarbon.

23. A process as defined in claim 22 wherein the refrigerant comprises Freon-12 which is maintained at a temperature not lower than about −15° C. (at about 0.9 kg/cm$^2$ gauge) within the heat exchanger of the intermediate fluid type.

24. A process as defined in claim 19 wherein the refirgerant is maintained at an increased pressure of about 0 to about 5 kg/cm$^2$ gauge within the heat exchanger of the intermediate fluid type.

* * * * *